US006640340B2

(12) United States Patent
Gibson

(10) Patent No.: US 6,640,340 B2
(45) Date of Patent: Nov. 4, 2003

(54) SWADDLING CLOTH

(76) Inventor: Lenise L. Gibson, 484 Lake Park Ave., #250, Oakland, CA (US) 94610

( * ) Notice: Subject to any disclaimer, the term of this patent is extended or adjusted under 35 U.S.C. 154(b) by 0 days.

(21) Appl. No.: 10/044,143

(22) Filed: Jan. 11, 2002

(65) Prior Publication Data

US 2003/0131411 A1 Jul. 17, 2003

(51) Int. Cl.[7] ..... A41B 13/06; A47G 9/02
(52) U.S. Cl. ..... 2/69.5; 5/482
(58) Field of Search ..... 5/482, 494, 922, 5/923, 655; 2/69.5, 69; D6/603; D2/719

(56) References Cited

U.S. PATENT DOCUMENTS

| | | | | | |
|---|---|---|---|---|---|
| 3,605,746 | A | | 9/1971 | Schaar | |
| 3,693,190 | A | * | 9/1972 | Hickling | 2/69.5 |
| 3,739,399 | A | * | 6/1973 | Sheahon | 2/69.5 |
| 3,794,033 | A | | 2/1974 | Ryan | |
| 4,216,773 | A | | 8/1980 | Ryan | |
| 4,300,563 | A | | 11/1981 | Brookfield | |
| 4,475,912 | A | | 10/1984 | Coates | |
| 4,573,990 | A | | 3/1986 | Ohsaki | |
| 4,979,250 | A | | 12/1990 | Troncone et al. | |
| D395,188 | S | * | 6/1998 | Rush | D6/603 |
| 5,852,827 | A | * | 12/1998 | Lear | 5/482 |
| 6,009,576 | A | | 1/2000 | Gramme et al. | |
| 6,028,240 | A | | 2/2000 | Wessel et al. | |
| D448,142 | S | * | 9/2001 | Callan | D2/719 |
| 6,341,397 | B1 | * | 1/2002 | Kliegl et al. | 5/482 |
| D473,037 | S | * | 4/2003 | Williams | D2/719 |

* cited by examiner

*Primary Examiner*—Alexander Grosz
(74) *Attorney, Agent, or Firm*—Brian Beverly

(57) ABSTRACT

A swaddling blanket (10) including a right-hand folding section (28) with a right side edge (22) having an angular extent (40) and a left-hand folding section (30) with a left side edge (26). Fold lines (42, 44) define the folds for right- and left-hand fold sections and in particular, right-hand fold line (42) positions right side edge (22) parallel with left-hand fold line (44) when right-hand fold section (28) is in its first fold position. This parallel arrangement prompts folding left-hand fold section (30) about fold line (44) at a slightly upward angle over right-hand fold section (28) and around to the back of an infant swaddled in the blanket, forming the blanket snugly around the infant with a minimum of unsecured excess material.

17 Claims, 4 Drawing Sheets

SWADDLING CLOTH

FIELD OF THE INVENTION

The present invention relates to the field of blankets, and particularly blankets for use with newborn infants.

BACKGROUND OF THE INVENTION

Swaddling clothes effectively simulate the natural cocoon-like environment of the mother's womb to which newborn babies are accustomed. Therefore, infants are commonly wrapped in swaddling clothes for warmth and comfort and to protect them from injury It is desirable that a blanket used for swaddling fit snugly around the infant for maximum effectiveness, yet be easily wrapped around the infant and easily removable when necessary. A common experience is for a swaddling cloth to unwrap into a disorganized aggregation of loose flaps, requiring that it be completely unfolded and wrapped again. Thus, design challenges exist to maximize comfort and ease of use.

U.S. Pat. No. 6,009,576 to Gramme discloses a generally T-shaped swaddling blanket having left-hand and right-hand wrapping flaps and a downwardly extending lower wrapping flap. Elastically gathered transverse regions are provided in the central portion of the T-shaped swaddling blanket to enhance the snug fit of the blanket about the infant. The background discussion of the '576 Gramme patent contains a useful analysis of swaddling cloth designs disclosed in other U.S. Patents. This background discussion is incorporated herein and should be consulted to put the present invention in proper context. None of the prior art discloses the advantages of the present invention as discussed in detail below and which it is believed represents a patentable improvement in the art of swaddling cloths.

SUMMARY OF THE INVENTION

In accordance with the present invention, a blanket for swaddling an infant is provided that includes a front panel and a back panel that form an interior compartment for receiving the infant. The lower edges wrap around the feet of the infant and the upper edges separate from each other to create an opening through which the infant can be positioned within the interior compartment with the head of the infant exposed. The right side edges of the front and back panels together form an angular extent such that the width of the front and back panels narrow adjacent their lower edges. The angular extent of the right side edges also creates an upward angular folding direction for the left-hand folding section of the blanket. The angular folding direction is oriented generally perpendicular to the angular extent of the right side edges when the right-hand folding section of the blanket is folded over the front side of the infant. The left-hand folding section has sufficient width for the left side edges to wrap around to the back side of the infant when the left-hand folding section is folded over both the front side of the infant and the right-hand folding section.

According to an aspect of the invention, the narrow width defined by the angular extent of the front and back panels has a width no greater than sufficient to allow the right-hand folding section, when folded over into a first fold position, to lie over but not extend beyond the front of the infant. In the first fold position, the right side edges of the front and back panels align with and over one side of the front of the infant.

According to another aspect of the invention, when the narrow width defined by the angular extent of the front and back panels is folded over the front of the infant in the first fold position, the right side edges of the front and back panels also align with the left side fold line for the left-hand folding section.

According to yet another aspect of the invention, the left side fold line is oriented at an angle to the centerline, the left side fold line being closer to the centerline adjacent the lower edges and farther from the centerline adjacent the upper edges, so that the left side fold line is generally parallel to the angular extent of the right side edges when the right-hand folding section is folded at the right side fold line in the first fold position.

According to yet still another aspect of the invention, the right side fold line is oriented at an angle to the centerline, the right side fold line being closer to the centerline adjacent the lower edges and farther from the centerline adjacent the upper edges, so that the right-hand folding section folds about the right side fold line at an upward angle to the centerline.

According to yet still another aspect of the invention, the left side edges include an upper angular portion proximate the upper edges of the front and back panels, the upper angular portion adapted to align transversely of the orientation of the infant and perpendicular to the centerline when the infant is positioned within the interior compartment, so that when the left-hand folding section of the blanket is folded over the infant, the upper angular portion thereof can be positioned under the chin of the infant.

DETAILED DESCRIPTION OF THE PREFERRED EMBODIMENT

Figure 1:
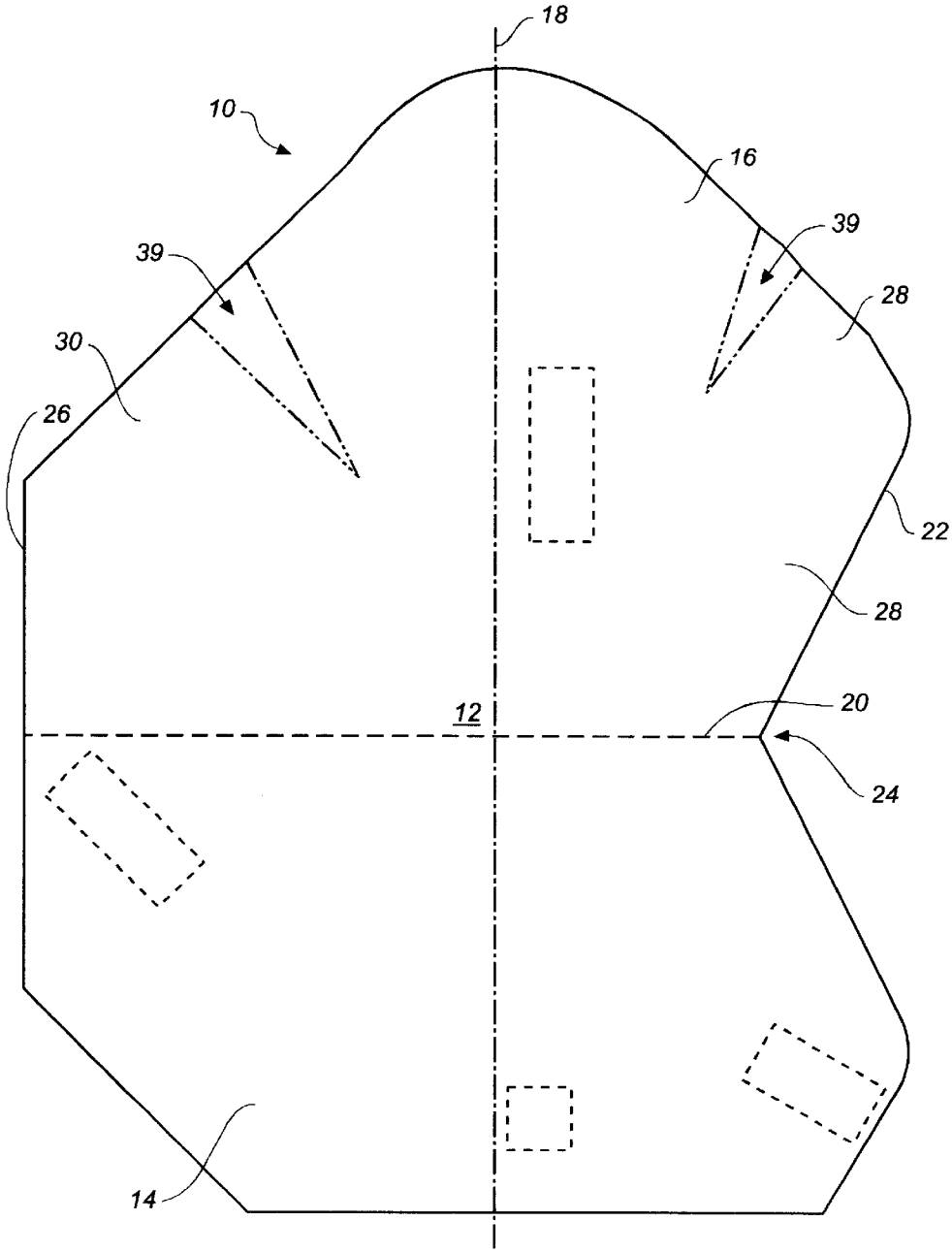
FIG. 1 is a plan view of the swaddling cloth of the present invention as cut from stock cloth material in an unfolded and unsewn condition.

FIG. 1 shows the swaddling cloth 10 of the present invention. Swaddling cloth 10 includes a main body panel 12 having a lower front panel 14 and an upper back panel 16. Front panel 14 and back panel 16 together have a centerline 18 along which an infant is positioned when swaddled within cloth 10. In an assembled configuration, front panel 14 is folded up onto the front side of back panel 16 in a manner defining a lower edge 20 that is generally perpendicular to centerline 18. Main body panel 12 has a right side edge 22 that includes a side cut 24 that narrows a mid-portion of the main body panel at lower edge 20. Main body panel 12 also has a left side edge 26 opposite right side edge 22. Centerline 18 defines a right-hand folding section 28 and a left-hand folding section 30.

Left side edge 26 is spaced from centerline 18 a distance greater than the distance between right side edge 22 and centerline 18 so that left side edge 26 can extend to the back side of the infant when left-hand folding section 30 is folded over the front side of the infant around to the back side of the infant. This is discussed in more detail later.

Side cut 24 of right side edge 22 creates an angular extent of right side edge 22 that narrows a width of front panel 14 and back panel 16 adjacent lower edge 20. The angular extent created by side cut 24 is formed with respect to centerline 18 so as to create an upward angular folding direction for left side edge 26 when right-hand folding section and right side edge 22 are folded over the front of the infant. This is also discussed in more detail later.

Figure 2:
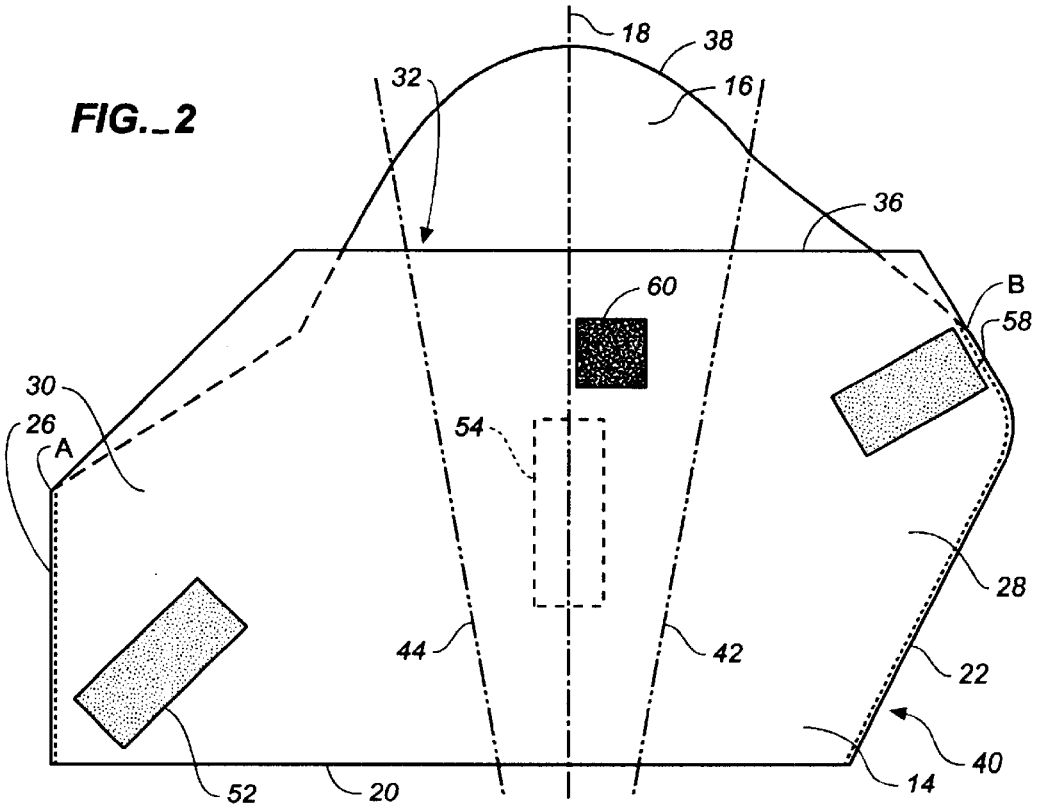
FIG. 2 is a front view of the swaddling cloth of the present invention in a fully sewn, assembled, and open condition.
Figure 3:
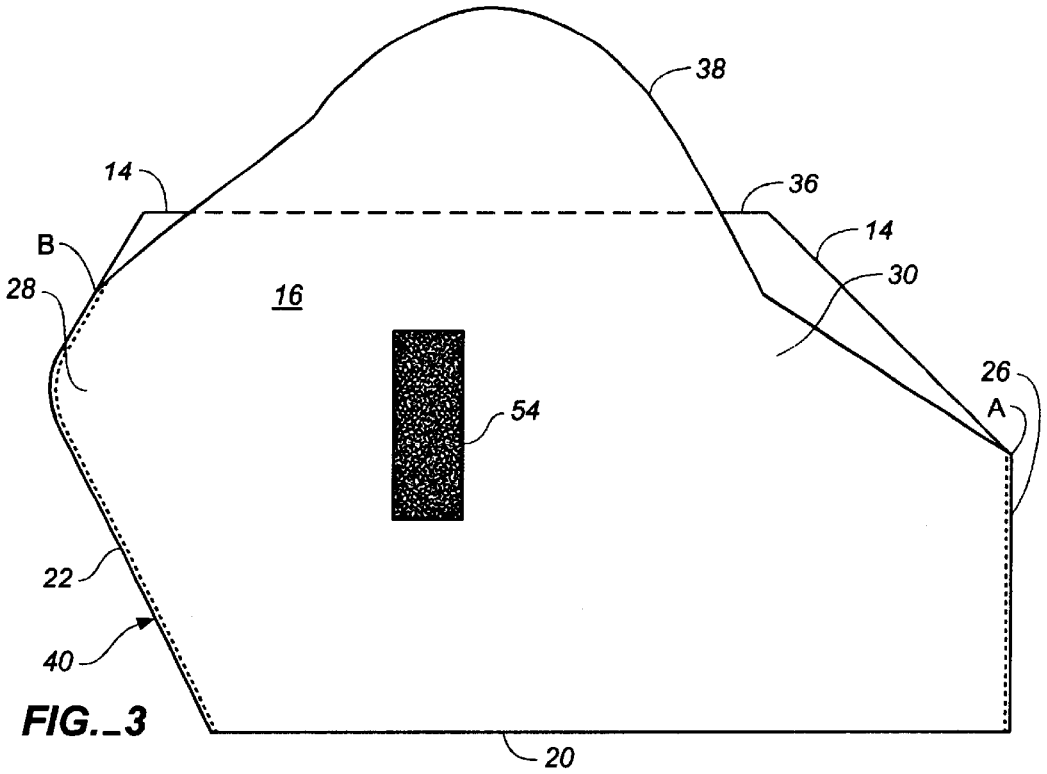
FIG. 3 is a back view of the swaddling cloth of FIG. 2.

Referring to FIG. 2, it is preferable, although not necessary to practice the invention, for side edges 22 and 26 to be stitched or sewn together from lower edge 20 up to points A and B. This creates a somewhat enclosed interior compartment 32 for receiving the infant with lower edge 20 wrapped around the feet of the infant. Front panel 14 has an upper edge 36 and back panel 16 has an upper edge 38. Upper edges 36, 38 are not sewn together in order to create a relatively wide opening through which the infant can be placed into the interior compartment. In the preferred embodiment seen in FIG. 2 upper edge 38 of back panel 16 extends upward farther than upper edge 36 of front panel 14 such that the head of an infant resting in the interior compartment may lie on back panel 16 with upper edge 36 of front panel 14 tucked under the infant's chin. Additionally, referring back to FIG. 1, the upper edge 38 of back panel 16 includes two darts 39 which form the interior compartment in a concave shape to better fit a infant swaddled in the blanket.

Right side edge 22 includes angular extent 40, created by the side cut, which narrows the width of right-hand folding section 28 adjacent lower edge 20. Right-hand folding section 28 is defined more precisely by a right-hand fold line 42 about which right-hand folding section 28 folds over onto the front side of the infant. Left-hand folding section 30 is defined by a left-hand fold line 44 about which left-hand folding section 30 folds over the right-hand folding section and around to the back side of the infant. Angular extent 40 of right side edge 22 creates an upward angular folding direction for left-hand folding section, and this is discussed in more detail in reference to FIGS. 6–9.

Mechanical fasteners are included to secure right-hand folding section 28 in its folded position and to secure left-hand folding section 30 in its folded position. While many types of mechanical fasteners can be used to secure the right- and left-hand folding sections, the preferred embodiment uses hook and loop fasteners. A first mechanical fastener includes loops 52, adjacent the junction of left side edge 26 and lower edge 20, and hooks 54 (shown in phantom) attached to the back side of back panel 16 proximate upper edge 36 of front panel 14. Mechanical fastener 52, 54 is adapted to securely fasten when left-hand folding section 30 is folded about left-hand fold line 44 over the front side of the infant and around to the back side of the infant.

In addition, a second mechanical fastener is provided to secure right-hand folding section 28. The second mechanical fastener includes loops 58 and hooks 60. Preferably, the sections of both loops 58 and loops 52 have an elongated configuration, i.e. a length greater than the width thereof, which allows for some adjustability in securing the mechanical fasteners to cooperating hooks 60 and 54 depending on the size of the infant.

Figure 4:
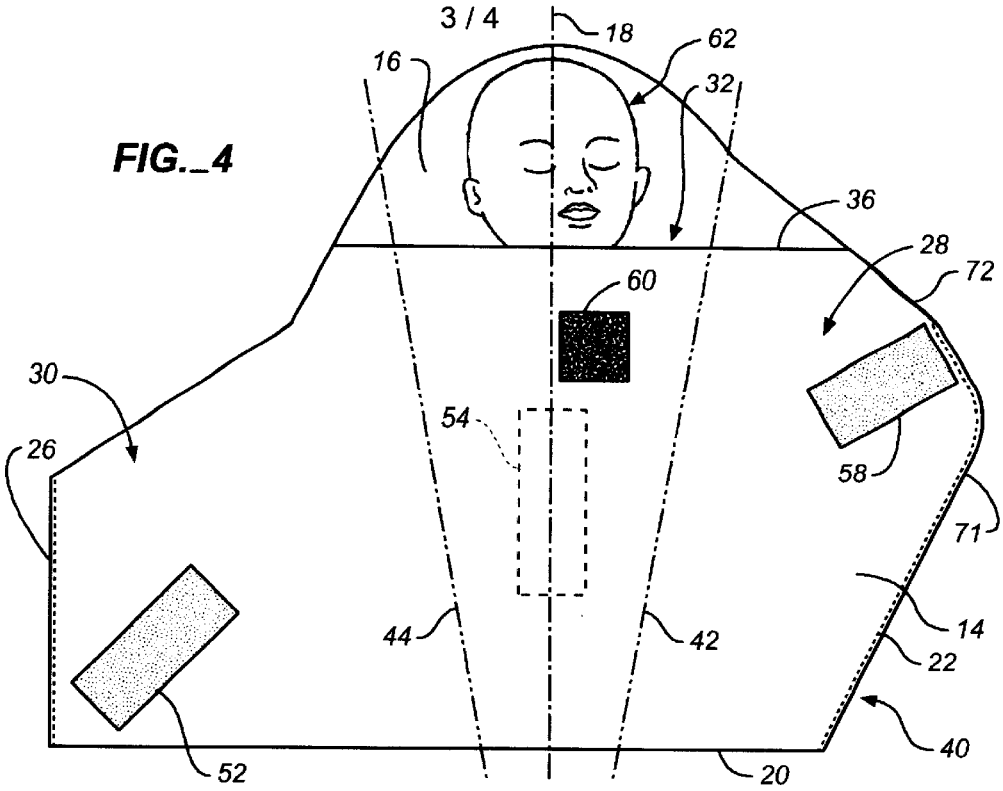
FIG. 4 is a front view of the swaddling cloth of FIG. 2, with an infant shown positioned within the interior compartment.
Figure 5:
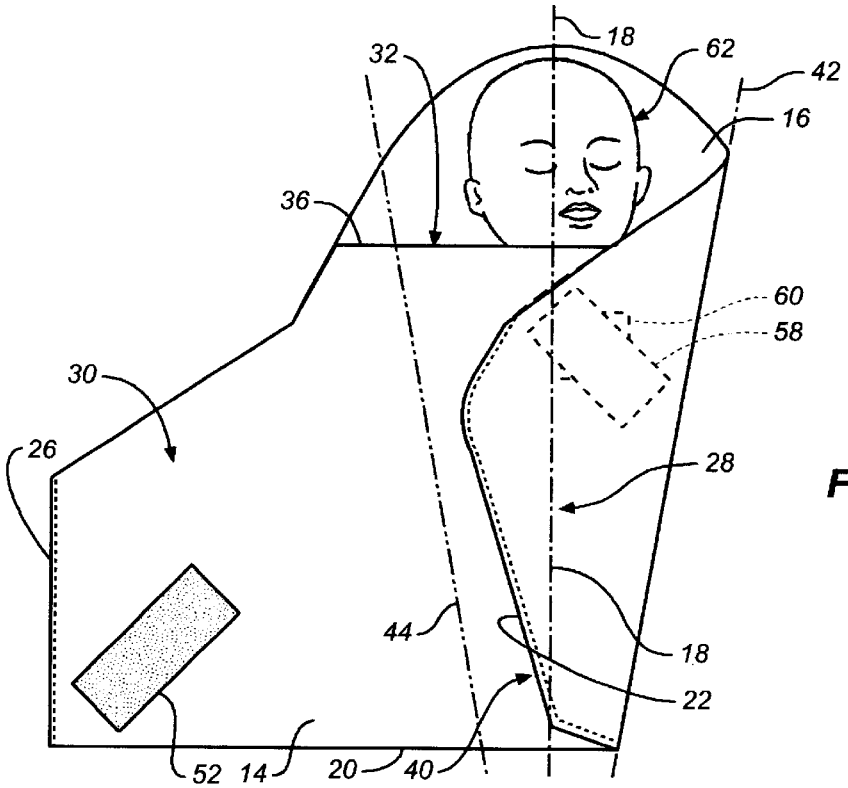
FIG. 5 is front view of the swaddling cloth and infant of FIG. 4, shown with the right-hand folding section folded over in a first fold position.

FIG. 4 shows an infant 62 within interior compartment 32 created by the overlying arrangement of front panel 14 and back panel 16. In this position, the length of the infant 62 is generally aligned with centerline 18. FIG. 5 shows right-hand folding section 28 folded about fold line 42 over the front side of infant 62 into a first folded position. Preferably, the narrow section of right-hand folding section 28 created by angular extent 40 has a width, as measured from centerline 18, no greater than sufficient to allow right-hand folding section 28 to fold over the front of the infant in its first fold position, with the angular side cut of right side edge 22 over one side of the front of the infant. In its first fold position, right side edge 22 aligns generally in parallel arrangement with left-hand fold line 44, as shown in FIG. 5. This parallel arrangement effectively creates a template for efficiently folding the swaddling cloth that also minimizes the amount of unsecured excess cloth when swaddling is complete.

Furthermore, left side fold line 44 is oriented at an angle to centerline 18, as shown in FIG. 5, with the spacing between the left side fold line 44 and centerline 18 less at lower edge 20 and greater adjacent upper edge 36. The orientation of fold lines 42, 44 are generally symmetrical about centerline 18 so that the right side fold line 42 is closer to centerline 18 adjacent lower edge 20.

Figure 6:
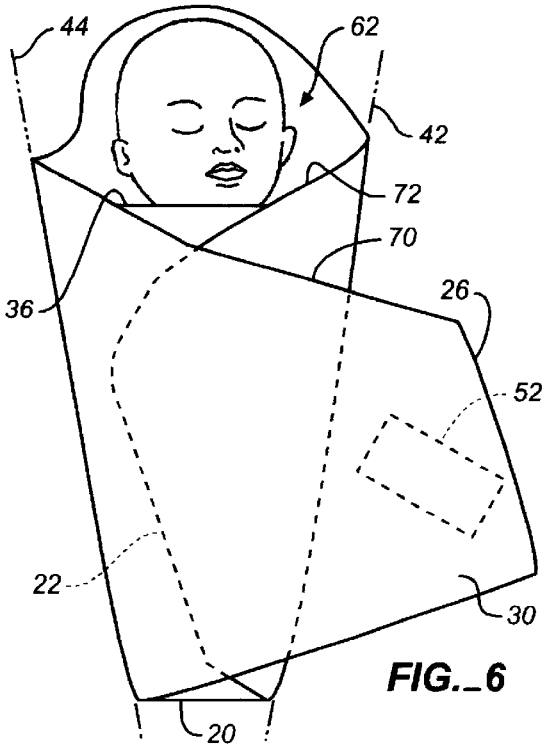
FIG. 6 is a front view of the swaddling cloth and infant of FIG. 4, shown with the left-hand folding section folded over in a second fold position.
Figure 8:
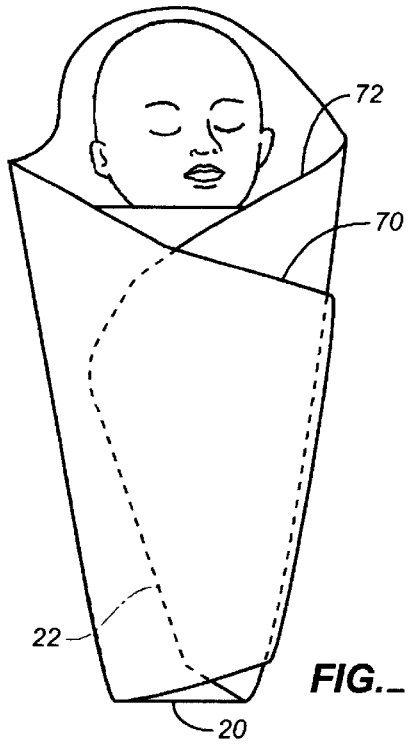
FIG. 8 is a front view of the swaddling cloth of FIG. 4, shown with the left-hand folding section folded around to the back side of the infant.
Figure 7:
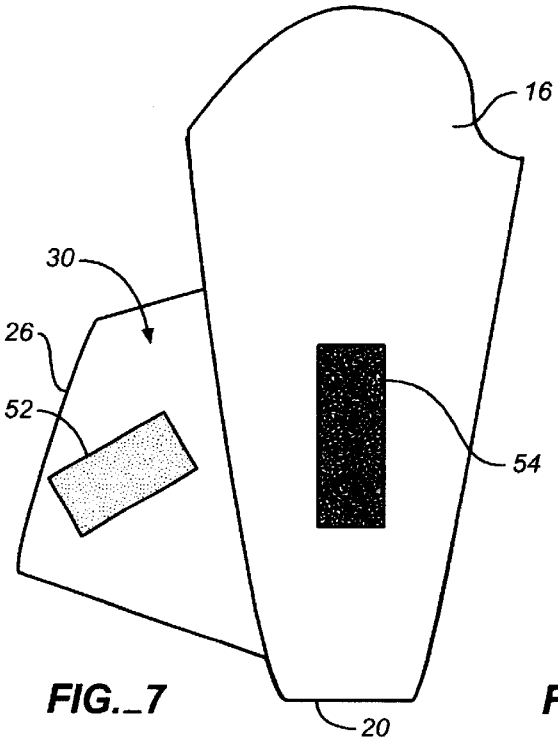
FIG. 7 is a back view of the swaddling cloth and infant of FIG. 6.
Figure 9:
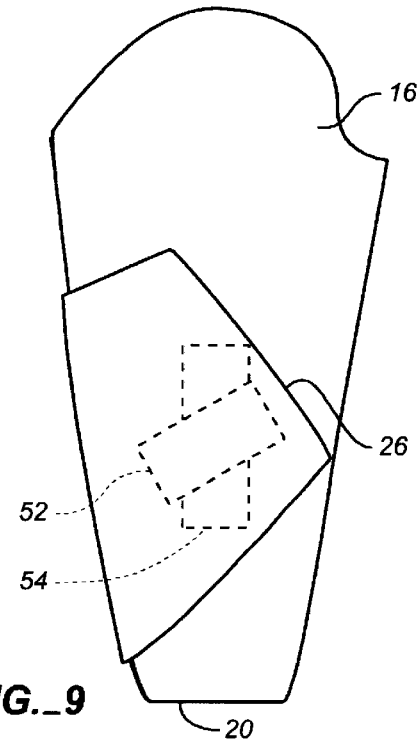
FIG. 9 is a back view of the swaddling cloth of FIG. 8, shown with the mechanical fastener of the left-hand folding section attached to a corresponding mechanical fastener on the back side of the swaddling cloth.

As seen in FIGS. 6 and 7, left-hand folding section 30 has sufficient width when folded over both the front side of the infant and the right-hand folding section 28 in a second fold position for left side edge 26 to extend to the back side of the infant. FIGS. 8 and 9 show the final fold position of left-hand folding section 30. In this final fold position, left side edge 26 wraps around to the back side of the infant so that loops 52 couple with hooks 54 adjacent the mid to upper regions of back panel 16.

As can be seen in FIGS. 6–9, the angular extent of right side edge 22 allows left-hand folding section 30 to fold into its second fold position (FIG. 6) and then final fold position (FIG. 8) at a slightly upward angle that is generally perpendicular to both left fold line 44 and the position of right side edge 22 when right-hand folding section 28 is in its first fold position. This slightly upwardly angled fold creates a mummy-bag configuration which generally conforms to the shape of infants and, in combination with the angular alignment of right side edge 22, minimizes the amount of cloth material necessary for the swaddling. This, in turn, makes the swaddling cloth easier to manage and manipulate.

According to another aspect of the preferred embodiment, left side edge 26 includes an upper angular portion 70, as shown in FIGS. 6 and 8, proximate upper edge 36. When left-hand folding section 30 folds around the front of the infant, upper angular portion 70 aligns transversely of the orientation of the infant and under its chin.

According to still another aspect of the preferred embodiment, right side edge 22 forms an outwardly angled segment 71 (FIG. 4) that extends from lower edge 20 and an inwardly angled segment 72 that extends from upper edge 36 and joins outwardly angled segment 71 approximate the shoulder of the infant. Inwardly angled segment 72 allows right-hand folding section 28 to tuck below the chin of the infant then in its first fold position, in a similar manner to that of upper angular portion 70.

The foregoing is a description of a preferred embodiment of the present invention. Many modifications and alterations may be made by those of ordinary skill in the art without departing from the spirit and scope of the invention. Such changes and modifications are considered to fall within the scope of the invention, as set forth in the foregoing description and summary of the invention and in the following claims.

I claim:

1. A blanket for swaddling an infant, comprising:

a front panel and a back panel, each having a lower edge, with the lower edges joined to define an interior compartment for receiving the infant with the lower edges wrapped around the feet of the infant, the front and back panels each having an upper edge, with the upper edges separate from each other for creating an opening through which the infant can be positioned within the interior compartment and out which the head of the infant can extend, the front and back panels generally having a centerline along which the infant is positioned within the interior compartment, the centerline being generally perpendicular to the upper and lower edges of the front and back panels, the front and back panels each having overlying right side edges, the right side edges having an angular extent relative the centerline, the front and back panels adjacent their lower edges having a narrow width defined by the angular extent of their right edges, the front and back panels proximate the right side edges having a right side fold line defining a right-hand folding section of the panels, the front and back panels also including left side edges opposite the right side edges, the front and back panels having a left side fold line proximate the left side edges defining a left-hand folding section of the panels, a first fold position formed when the right-hand folding section is folded about the right side fold line over the front side of an infant in the interior compartment, the angular extent of the right side edges in the first fold position forming an upward angular folding direction for the left-hand folding section, the angular folding direction being oriented generally perpendicular to the angular extent of the right side edges of the right-hand folding section in the first fold position, and a second fold position formed when the left-hand folding section is folded about the left side fold line in the upward angular folding direction over both the front side of an infant in the interior compartment and the right-hand folding section in the first fold position, the left-hand folding section in the second fold position having sufficient width for the left side edges of the front and back panels to extend to the back side of that infant.

2. The blanket of claim 1 wherein the narrow width of the front and back panels has a width no greater than sufficient to allow the right-hand folding section to fold over the front of the infant in the first fold position and align the angular extent of the right side edges over the front of the infant.

3. The blanket of claim 2 wherein the angular alignment of the right side edges forms an outwardly angled segment of the right side edges extending upwardly from the lower edges of the front and back panels, and wherein the right side edges further include an inwardly angled segment adjacent the upper edges of the front and back panels, the inwardly angled segment joining the outwardly angled segment proximate the shoulders of an infant positioned within the interior compartment of the blanket.

4. The blanket of claim 1 wherein the narrow width of the front and back panels is no wider than sufficient to allow the right-hand folding section to fold over the front of the infant in the first fold position and align the angular extent of the right side edges with the left side fold line.

5. The blanket of claim 4 wherein the left side fold line is oriented at an angle to the centerline with the left side fold line closer to the centerline adjacent the lower edges of the front and back panels and farther from the centerline adjacent the upper edges of the front and back panels, so that the left side fold line is generally parallel to the angular extent of the right side edges when the right-hand folding section is in the first fold position.

6. The blanket of claim 1 wherein the right side fold line is oriented at an angle to the centerline with the right side fold line closer to the centerline adjacent the lower edges of the front and back panels and farther from the centerline adjacent the upper edges of the front and back panels, so that the right-hand folding section folds about the right side fold line at an upward angle to the centerline.

7. The blanket of claim 1 wherein the left side edges include an upper angular portion proximate the upper edges of the front and back panels, the upper angular portion for transverse alignment with an infant positioned within the interior compartment, so that the upper angular portion can be positioned under the chin of that infant.

8. The blanket of claim 1 wherein the front panel includes a mechanical fastener adjacent the junction of the left side edge and lower edge thereof, and the back panel includes a cooperating mechanical fastener proximate the upper edge of the back panel, the cooperating mechanical fastener of the back panel disposed to securely fasten with the mechanical fastener on the front panel when the left-side folding section in the second fold position is folded about the left side fold line over the front side of an infant in the interior compartment and the left side edges extend around to the back side of that infant.

9. The blanket of claim 8 wherein the mechanical fastener and cooperating mechanical fastener together comprise a hook and loop fastener with one of the hook and the loop portions of the fastener having an elongated length that is aligned with the upward angular folding direction.

10. The blanket of claim 9 wherein the other of the hook and loop portions of the fastener has an elongated length perpendicular to the upward angular folding direction to provide a range of folding directions for securing the left-hand folding section.

11. A blanket for swaddling an infant, comprising:

a main body panel generally having a centerline along which an infant is positioned when swaddled within the blanket, the main body panel having a front panel and a back panel that when folded together define an upper edge and a lower edge generally perpendicular to the centerline, the main body panel having a mid-portion, the main body panel further having a right side edge that includes a side cut that narrows the mid-portion, the main body panel also including a left side edge opposite the right side edge, the left side edge being spaced from the centerline a distance greater than the distance between the right side edge and the centerline and sufficient for the left side edge to extend to the back side of an infant swaddled in the blanket when the left side edge is folded over the front side of that infant and around to the back side of that infant, and when the front and back panels are folded together, the side cut of the right side edge creating an angular extent of the right side edge, the front and back panels adjacent the lower edge having a narrow width defined by the angular extent, the angular extent formed with respect to the centerline so as to create an upward angular folding direction for the left side edge when the right side edge is folded over the front of an infant swaddled in the blanket.

12. The blanket of claim 11 wherein the left side edge includes an upper angular portion proximate the upper edge of the main body panel, the upper angular portion adapted to align perpendicular to the centerline when an infant is positioned within the blanket, and transversely of the orientation of that infant so that the upper angular portion can be positioned under the chin of that infant.

13. The blanket of claim 11 wherein the right side edge includes an inwardly angled segment adjacent the upper edge.

14. The blanket of claim 11 wherein the upper edge includes a pair of darts extending downwardly and inwardly toward the centerline for forming the back panel of the main body panel into a concave shape.

15. The blanket of claim 11 wherein the front panel includes a mechanical fastener adjacent the junction of the left side edge and lower edge and the back panel includes a cooperating mechanical fastener proximate the upper edge, the cooperating mechanical fastener of the back panel adapted to securely fasten with the mechanical fastener on the front panel when the left side edge is folded over the front side of an infant swaddled in the blanket and around to the back side of that infant.

16. The blanket of claim 15 wherein the mechanical fasteners are hook and loop fasteners with one of the hook and the loop portions of the fasteners having an elongated length that is aligned with the upward angular folding direction.

17. The blanket of claim 16 wherein the other of the hook and loop portions of the fastener has an elongated length perpendicular to the upward folding direction to provide a range of folding directions for the left-hand folding section.

* * * * *